US005290981A

United States Patent [19]

Yuda

[11] Patent Number: 5,290,981

[45] Date of Patent: Mar. 1, 1994

[54] SWITCH POSITIONING APPARATUS AND METHOD

[76] Inventor: Lawrence F. Yuda, P.O. Box 499, Westminster, S.C. 29693

[21] Appl. No.: 964,059

[22] Filed: Oct. 21, 1992

[51] Int. Cl.[5] ..... H01H 9/08

[52] U.S. Cl. ..... 200/296; 200/294; 361/807

[58] Field of Search ..... 200/296, 294, 293; 335/202; 338/315, 317; 361/417, 419, 420, 331; 248/500, 506

[56] References Cited

U.S. PATENT DOCUMENTS 4,351,620 9/1982 Stritt et al. ..... 200/294 X
4,716,496 12/1987 Fritsch ..... 200/296 X
4,764,847 8/1988 Eisenblatter et al. ..... 361/420 X
4,899,252 2/1990 Birzer ..... 361/419 X

FOREIGN PATENT DOCUMENTS 2077040 12/1981 United Kingdom ..... 200/294

*Primary Examiner*—Renee S. Luebke
*Attorney, Agent, or Firm*—Ralph Bailey

[57] ABSTRACT

Apparatus for positioning magnetic switches in alignment on a base member has a contact edge (C) at one end and a threaded post (D) adjacent the other end. Wedging the contact edge (C) into engagement with a lower surface of an elongated groove (A) is accomplished by tilting the switch upwardly at the other end by means of threadably manipulating the post so as to extend downwardly engaging the stop members (E) with the inward projections (B).

5 Claims, 2 Drawing Sheets

Fig. 3.
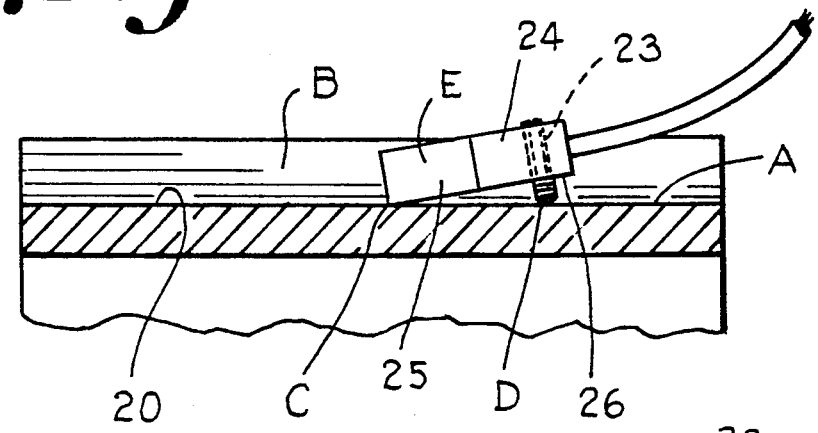
Fig. 4.
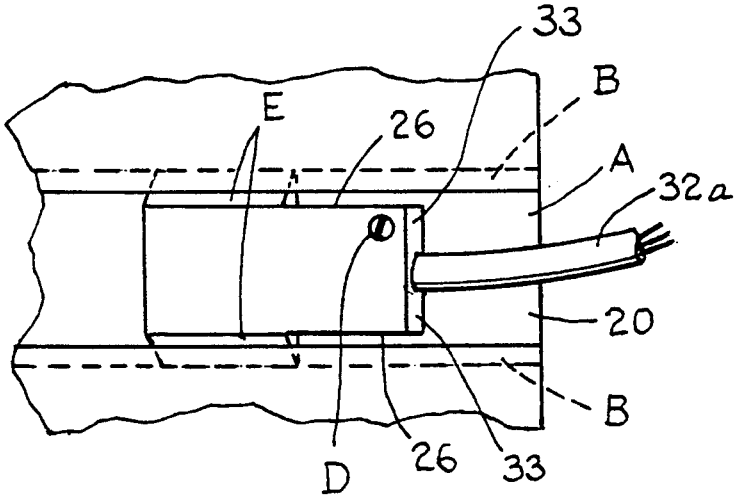
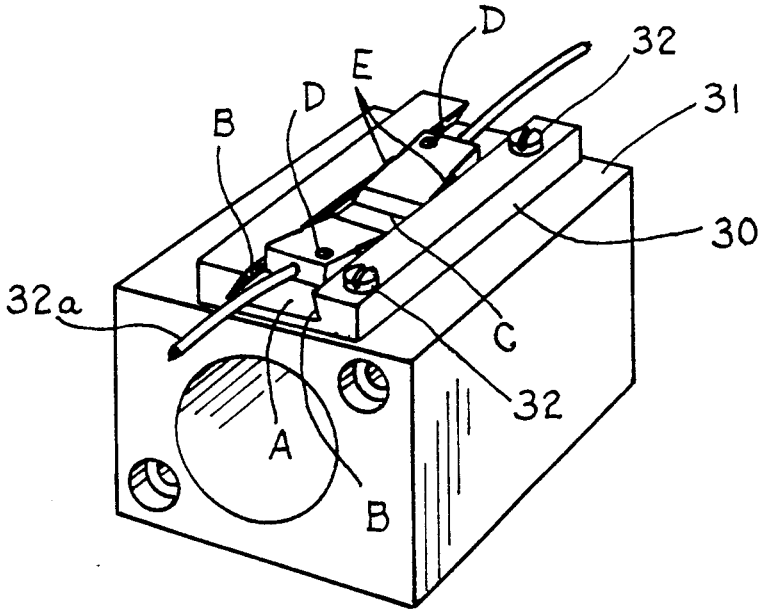
Fig. 5.

SWITCH POSITIONING APPARATUS AND METHOD

BACKGROUND OF THE INVENTION

This invention relates to apparatus for positioning switches in longitudinal alignment for adjustable spacing as when sensing the positioning of a magnetic field such as illustrated in the Robotic Control Apparatus of U.S. Pat. No. 4,723,503.

Heretofore difficulties have been presented in holding down and positively positioning a plurality of spaced switches in longitudinal adjustable positions. Switching apparatus as contemplated herein utilizes a channel or groove forming a rail for carrying the switches for longitudinal adjustment. By fastening the rail with spaced screws with the legs or flanges extending downwardly toward the cylinder to confine the switches, adjustment may be achieved through loosening the screws. Such a construction has resulted in the switches becoming loose when the device is in operation causing faulty operation.

The clamping apparatus disclosed in U.S. Pat. No. 4,903,933 solves many of the problems inherent in the switching described, but has the disadvantage of breakage due to fatigue incurred by the locking bracket which holds the switches down.

Another effort to solve the above problem is illustrated in U.S. patent application Ser. No. 07/951,761 entitled APPARATUS FOR ADJUSTABLY POSITIONING SWITCHES, filed Sep. 28, 1992.

Efforts to provide proper positioning apparatus further include the use of a threaded post wedging tapered sides of a switch into engagement with complementary sides of a groove. Such devices position the post in offset relation so that a space entirely separates the switch from the groove as described in greater detail below.

The apparatus of the invention is also useful in other applications where it is desired to positively adjustably position a plurality of longitudinal spaced elements.

SUMMARY OF THE INVENTION

Accordingly, it is an important object of this invention to provide a switch positioning apparatus and method wherein the switches are readily adjustable and mounted in a longitudinal groove being easily fastened in any position through the tightening of a threaded post.

Another important object of the invention is to provide a magnetic switch positioning apparatus wherein a contact edge engages the base of the positioning groove and is thereby in proper position to carry out its function.

Another important object of the invention is to provide a positively positioned switch adjustably carried on a trackway wherein an upright threaded post wedges the switch into position for causing a contact edge to be firmly placed by the groove for positively positioning the switch for optimal use.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 3 is a longitudinal sectional elevation taken on the line 3—3 in FIG. 2 illustrating the wedging action produced by the post when clamping a contact edge of a switch into engagement with the track for optimal operation placing the switch in a downwardly inclined position toward the contact edge;

FIG. 4 is an enlarged top plan view illustrating a switch in fixed position on the track; and FIG. 5 is a perspective view illustrating a modified form of the invention wherein a groove is provided by attaching a track having sides which project and taper inwardly from the bottom, and being attached to the base member rather than being integral with the base member.

DESCRIPTION OF A PREFERRED EMBODIMENT

The drawings illustrate apparatus for positioning a plurality of switches in alignment on a base member. An elongated groove A on the base member forms a track. Aligned opposed inward projections B in the groove form first stop members. A switch slidably carried in the groove has a contact edge C at one end thereof. A post D carried adjacent the other end of the switch projects below the switch engaging the switch and a lower portion of the groove. Second stop members E carried by the switch engage the first stop members. Thus, the contact edge C is wedged into engagement with a lower surface of the groove by reason of the switch being tilted upwardly at the other end by means of the post so as to extend downwardly toward the one end.

Figure 1:
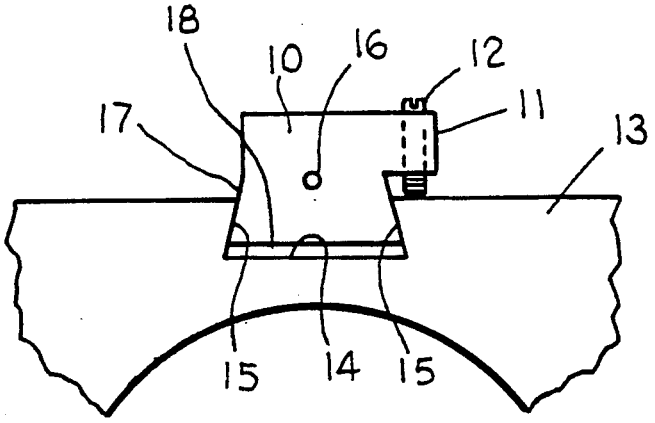
PRIOR ART Fig. 1.
FIG. 1 is an end view illustrating a switch positioned in an elongated groove having inwardly inclined sides utilizing an upright screw for positively positioning the switch by providing an air gap between a base of a switch and the mounting track in accordance with the prior art.

Prior art is illustrated in FIG. 1 wherein a switch 10 has an offset portion 11 which carries a vertical threaded post 12. The base member 13 has a groove with a bottom 14 which has upwardly extending inwardly tapering sides 15 carried thereby. The switch has a lead 16 extending from a central end portion thereof. It will be observed that a lower portion of the switch has complementary sides 17 which are engageable with the sides 15 since they extend upwardly and inwardly with complementary angles so as to provide an air space 18 between a base of the switch and the bottom 14 of the trackway or groove in order to accurately position a base of a Hall effect sensing magnetic switch and the like as illustrated herein.

Figure 2:
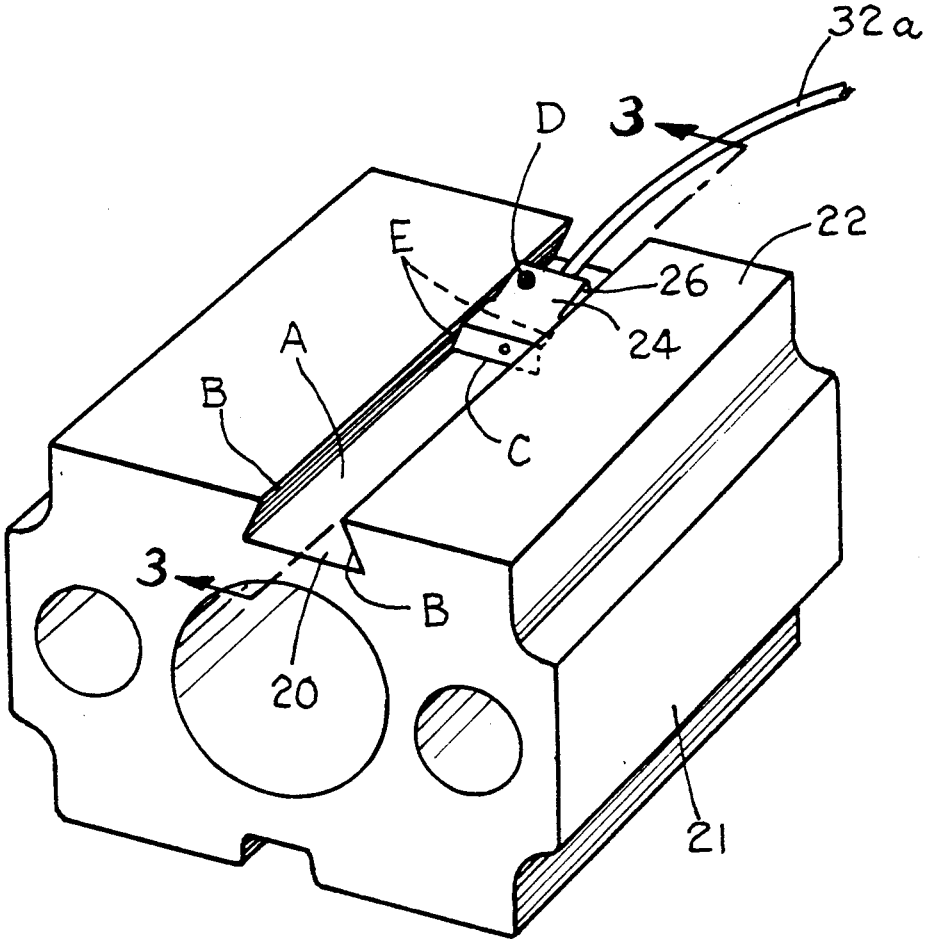
FIG. 2 is a perspective view illustrating apparatus for positioning switches in alignment on a base member constructed in accordance with the present invention.

It is important, however, that a contact edge portion of the base of the switch be accurately positioned, adjustable and locked down with respect to the rail or base member. FIGS. 2–3 illustrate a preferred embodiment of a switch positioning apparatus and method for accomplishing this. The elongated groove A is illustrated as having a base or bottom portion 20 and upwardly and inwardly projecting sides B defining a groove or a track within the base member itself which in this instance is a cylinder 21. The cylinder has an upper surface 22 in alignment opposite inward projections at the groove forming first stop members.

The contact edge C of the Hall effect switch is carried in the groove at one end of the switch and engages the base 20 of the groove A. The post D is received within an internally threaded portion 23 in a rearward portion 24 of the body of the switch. The body of the switch extends forwardly and downwardly when properly positioned and presents an enlarged portion for engagement as second stop members E. The second stop members E have complementary upwardly tapering sides 25 for engagement with the upwardly and inwardly projecting sides B of the groove. The rearward portion of the switch 24 carried at the end thereof opposite contact.edge C has vertical flat sides 26 providing a reduced width so as to permit the rear area 24 to clear the upper edges of the sides B forming the groove A. It will be observed, however, that the complementary sides 25 perform as second stop member E so as to carry out the wedging action achieved by turning the post so as to extend a lower portion thereof toward the base of the groove 23 to produce the inclined wedging effect described above.

Referring now to FIG. 5, a modified form of the invention is illustrated wherein the groove or track is formed by an external trackway 30. The trackway 30 is fastened and positioned upon an upper surface 31 of the cylinder as by suitable spaced screws 32.

It will be observed in all embodiments of the invention that an electrical lead 32*a* is provided centrally of an end 33 of the switches remote from the contact edge C. If will be further observed that while the threaded post D is positioned adjacent one side of the rear portion 24 of the switches, it is closely adjacent the end opposite the contact edge C for carrying out the wedging with the switch in full engagement of the contact edge within the groove A as illustrated.

It will be noted, therefore, that a magnetic rail switching apparatus has been provided wherein positioning is positive and accurate with a contact edge in engagement with a base surface of a groove. The switches are readily adjusted and secured in a downwardly inclined wedged position wherein a rear portion of the switch is elevated by a contact edge on an opposite end and accurately positioned in a contact relationship with a groove or trackway.

While a preferred embodiment of the invention has been described using specific terms, such description is for illustrative purposes only, and it is to be understood that changes and variations may be made without departing from the spirit or scope of the following claims.

I claim:

1. Apparatus for positioning a switch on a base member comprising:

an elongated groove on said base member forming a track;

sides forming said elongated groove;

aligned opposed inward projections forming first stop members at said sides;

a switch slidably carried in said groove having a transverse contact edge at one end thereof;

a post carried adjacent the other end of said switch projecting below said switch engaging the switch and a lower portion of said groove positioning said other end of said switch by urging said other end outwardly away from said lower portion of said groove; and second stop members carried by said switch intermediate said contact edge and said post engaging said first stop members;

whereby said contact edge is wedged into engagement with a lower surface of said groove by reason of said switch being tilted upwardly at said other end by means of the post so as to extend downwardly toward said one end.

2. The structure set forth in claim 1 wherein said post is threadably mounted in upright position on said switch.

3. The structure set forth in claim 2 wherein said first stop members are inwardly inclined inner sides of said groove and said second stop members are complementary sides adjacent said one end of said switch remote from said post.

4. The structure set forth in claim 3 wherein said post is mounted adjacent one side of said switch.

5. The method of positioning a switch in alignment on a base member comprising the steps of:

slidably carrying a switch having a contact edge at one end thereof in an elongated groove having inwardly tapering sides;

threadably mounting a post adjacent the other end of said switch projecting below said switch engaging the switch and a lower portion of said groove;

providing stop members on said switch engaging said inwardly tapering sides; and wedging said contact edge into engagement with a lower surface of said groove by reason of said switch being tilted upwardly at said other end by means of the post so as to extend downwardly toward said one end.

* * * * *